US005398348A

United States Patent [19]

Tashiro et al.

[11] Patent Number: 5,398,348

[45] Date of Patent: Mar. 21, 1995

[54] WATER URINAL

[75] Inventors: Yukio Tashiro; Noriyuki Matsui; Ryuzo Fukuda; Manabu Hirahara; Naoki Tsukamura, all of Fukuoka, Japan

[73] Assignee: Toto Ltd., Fukuoka, Japan

[21] Appl. No.: 372,707

[22] Filed: Jun. 26, 1989

[30] Foreign Application Priority Data

Jun. 25, 1988 [JP] Japan ..... 63-157600

[51] Int. Cl.[6] ..... E03D 13/00

[52] U.S. Cl. ..... 4/304; 4/310; 4/DIG. 3

[58] Field of Search ..... 4/301-305, 4/306, 310, 311, 312, 313, 314, 661, 664, 405, 406, DIG. 3, DIG. 15

[56] References Cited

U.S. PATENT DOCUMENTS

| | | | |
|---|---|---|---|
| 473,715 | 4/1892 | Shanks | 4/303 |
| 650,897 | 6/1900 | Hinsdale | 4/311 |
| 1,206,921 | 12/1916 | Scarborough | 4/306 |
| 2,552,625 | 5/1951 | Filliung, Jr. | 4/DIG. 3 |
| 3,314,081 | 4/1967 | Atkins et al. | 4/304 |
| 3,524,068 | 8/1970 | Zorn | 250/239 |
| 4,203,173 | 5/1980 | Morris et al. | 4/302 |
| 4,586,692 | 5/1986 | Stephens | 4/407 X |
| 4,692,951 | 9/1987 | Taki et al. | 4/664 |
| 4,742,583 | 5/1988 | Yoshida et al. | 4/304 X |

FOREIGN PATENT DOCUMENTS

| | | | |
|---|---|---|---|
| 1033907 | 7/1978 | Canada . | |
| 0177967 | 4/1986 | European Pat. Off. . | |
| 0228908 | 7/1987 | European Pat. Off. . | |
| 313734 | 7/1988 | European Pat. Off. | 4/304 |
| 348864 | 1/1990 | European Pat. Off. | 4/305 |
| 2224607 | 10/1974 | France . | |
| 2436611 | 2/1976 | Germany | 4/305 |
| 8812215 | 11/1988 | Germany . | |
| 22736 | 4/1913 | United Kingdom | 4/310 |
| 518855 | 3/1940 | United Kingdom | 4/310 |
| 570825 | 4/1945 | United Kingdom | 4/311 |
| 1137353 | 12/1968 | United Kingdom . | |
| 2158475 | 11/1985 | United Kingdom | 4/305 |

OTHER PUBLICATIONS

Strangfeld, "Urinal with Electronically Controlled Solenoid", Feb. 19, 1976.

*Primary Examiner*—Robert M. Fetsuga

*Attorney, Agent, or Firm*—Sandler, Greenblum & Bernstein

[57] ABSTRACT

A water urinal has a urinal body which includes a housing with an opening on its upper portion for receiving a valve used to supply flushing water to the urinal. The valve is attractively concealed within the body of the urinal and eliminates the necessity of embedding a valve in the wall surface on which the urinal is mounted. A cover, which covers and provides access to the valve receiving space within the urinal body, allows maintenance of the urinal without having to remove the urinal from the wall or break an opening in the wall.

11 Claims, 8 Drawing Sheets

WATER URINAL

BACKGROUND OF THE INVENTION

This invention relates to a water urinal.

A conventional urinal is provided with a valve for supplying flushing water to a bowl portion, that is, a flush valve or an electromagnetic valve. Such a valve is mounted exposed to the uppermost portion of a urinal body or the valve is received into a recessed portion formed in a wall surface on which a urinal is installed, and the recessed portion is covered by a cover.

However, in the case of the former, the valve itself is exposed, impairing the external appearance. In the case of the latter, since the valve is received into the recessed portion of the wall surface, its external appearance is good but it takes much time to form the recessed portion for receiving the valve and it is very cumbersome to provide piping for connecting a water pipe to the valve within a narrow recessed portion.

In addition, in the case of the latter, if a valve is causually received into the recessed portion as described above, there arises a problem that maintenance cannot be carried out from the outside.

SUMMARY OF THE INVENTION

In view of the foregoing, the present invention provides a urinal which is good in external appearance without a flushing water supplying valve being exposed and which is readily installed without the necessity of forming a valve receiving recessed portion in a wall surface.

The present invention further provides a urinal of the type as described above which can repair and check a valve without removing the urinal or without breaking the wall surface.

For achieving the aforesaid objects, in a urinal according to the present invention, a receiving space is integrally formed in an upper portion of a bowl of a urinal body, and a valve for supplying flushing water to the bowl is received in the space.

Such a urinal enables a flushing water supplying valve to be received and concealed within a urinal body, eliminates the necessity of embedding a valve in a wall surface on which urinal is installed in order to improve the external appearance, thereby improving time in execution and workability.

Further, in the aforementioned urinal, an opening which is open to the surface of the urinal body and opened and closed by a cover is provided in a receiving space.

This enables a valve, which is received in and installed in the receiving space of the urinal body, to be maintained from the exterior by opening the opening. There are advantages that work such as removal of the urinal from the wall surface and breaking of the wall surface for repair and checking of the valve is eliminated.

Other objects and features of the present invention will become apparent from the ensuing description in connection with the accompanying drawings.

DESCRIPTION OF THE PREFERRED EMBODIMENTS

Figure 1:
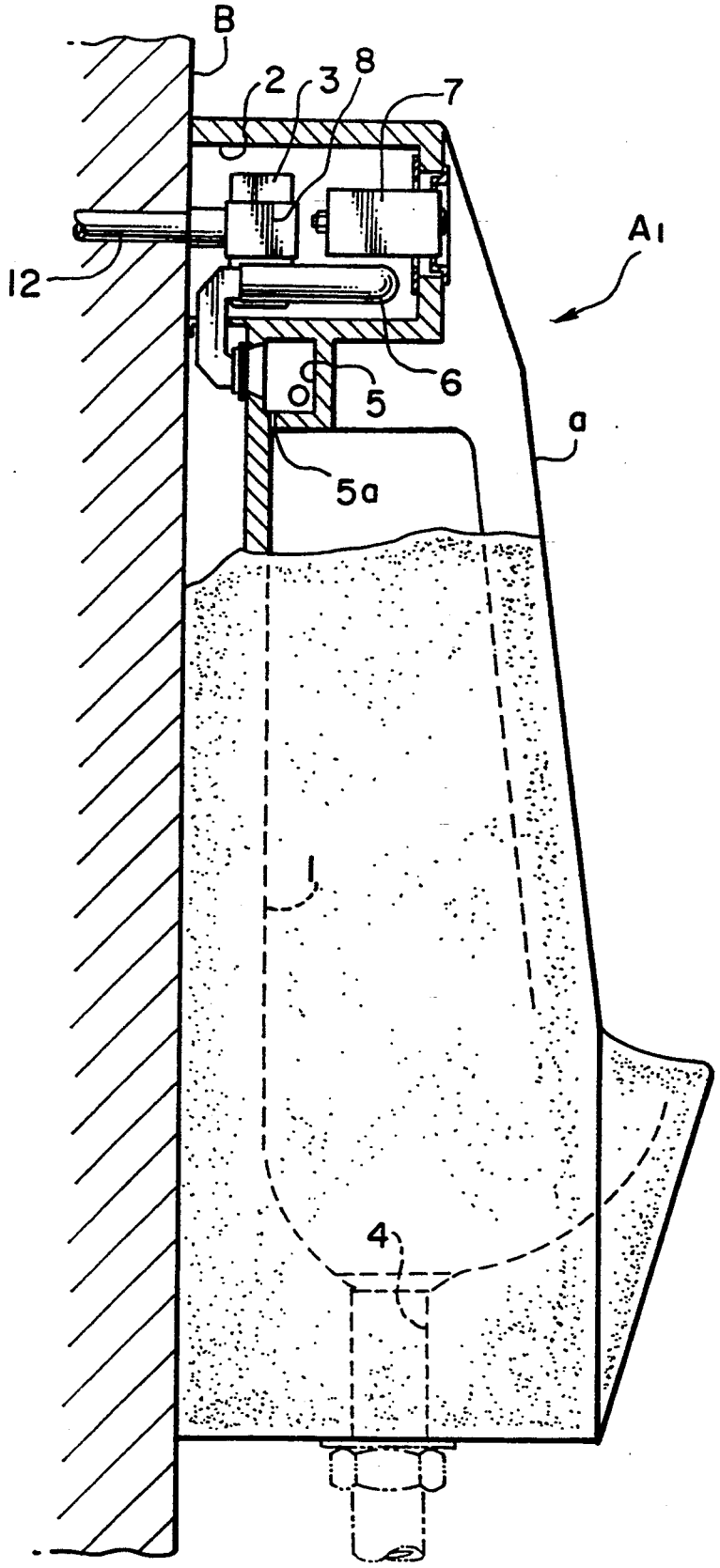
FIG. 1 is a partly cutaway side view showing one embodiment of a urinal according to the present invention.
Figure 2:
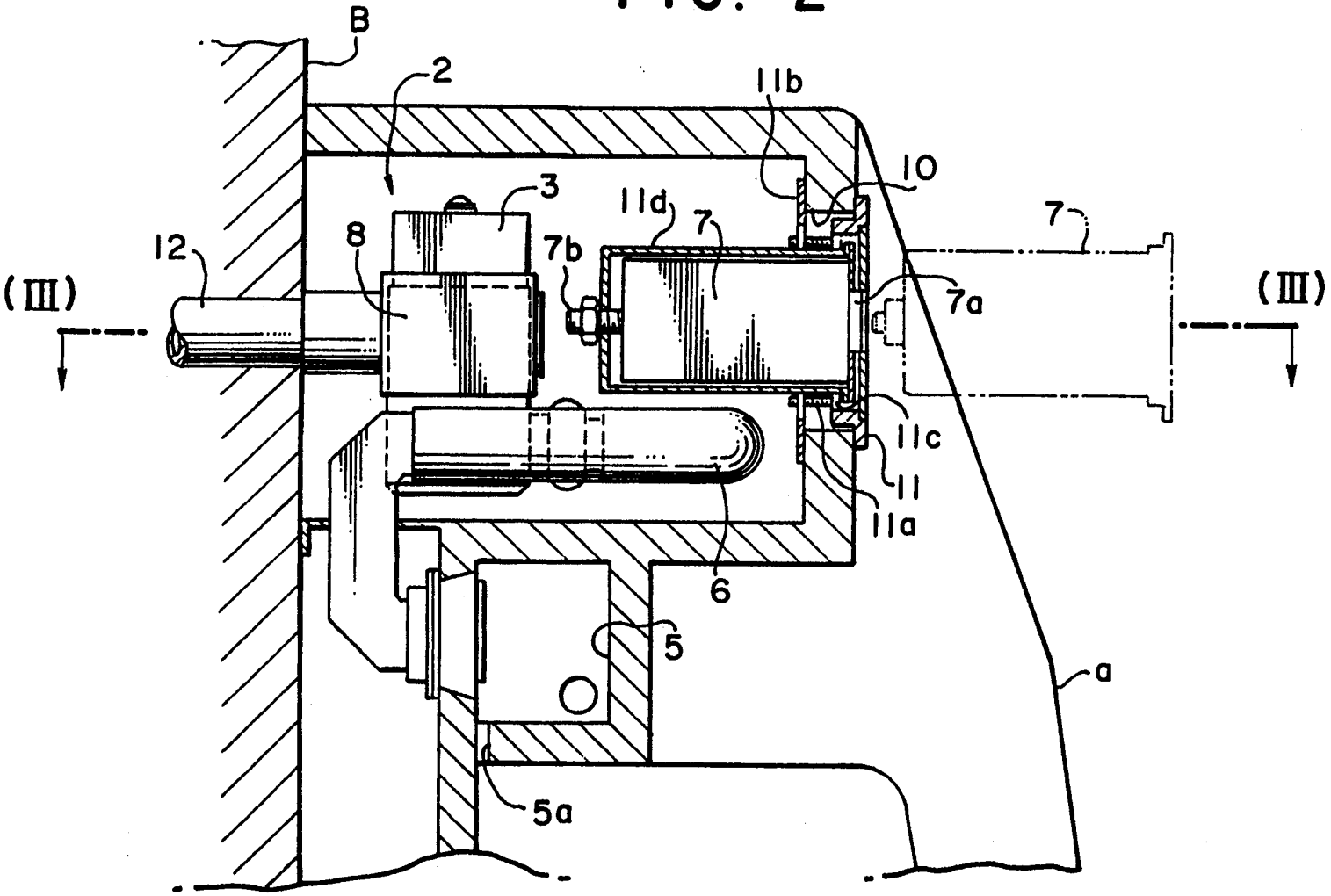
FIG. 2 is an enlarged sectional view showing a valve portion of the urinal.
Figure 3:
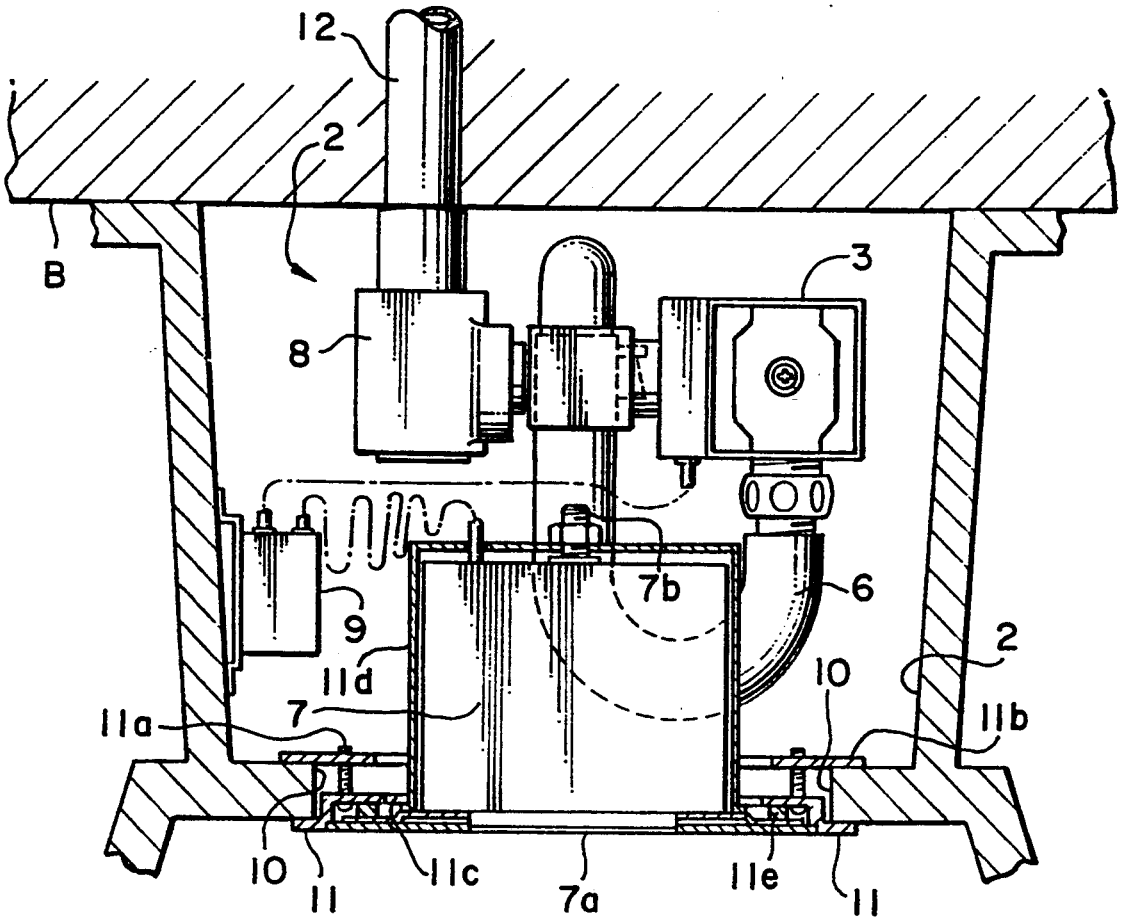
FIG. 3 is a sectional view taken on line III—III of FIG. 2.

In a urinal $A_1$ shown in FIGS. 1 to 3, a receiving space 2 is formed in an upper portion of a bowl portion 1 of a urinal body a, and an electromagnetic valve 3 for supplying flushing water to the bowl portion 1 is received into the space 2, the urinal being installed on a wall surface B of a building.

The urinal body a is made of ceramics. The bowl portion 1 is largely opened to the front surface of the urinal, the bowl portion being provided at the bottom with a drain 4, the receiving space 2 being integrally formed at the upper portion of the bowl portion 1, the back of the urinal being placed in abutment with the wall surface B.

The receiving space 2 receives therein the electromagnetic valve 3 for supplying flushing water to the bowl portion 1 and members and devices relevant thereto, the back of the space being opened. By mounting the urinal body a on the wall surface B from the front surface thereof, a stop cock 8 connected to the end of a water pipe 12 and projected from the wall surface B, the electromagnetic valve 3 and a communication pipe 6 can be received into the receiving space 2.

The receiving space 2 is provided on the front surface side with an opening 10 which is open to the front surface of the urinal body a, the opening 10 being opened and closed by a cover 11.

The electromagnetic valve 3 is opened and closed by control of a sensor and controller 7 received into the receiving space 2, the valve having an inlet connected downstream of the stop cock 8 and an outlet being communicated to a flushing water passage 5 formed within the urinal body a by the communication pipe 6 at the uppermost portion of the bowl portion 1.

Communication between the outflow side of the electromagnetic valve 3 and the flushing water passage 5 can be carried out from the outside of the urinal body a through the opening 10 even after the urinal body a has been installed.

The cover 11 for opening and closing the opening 10 of the receiving space 2 cover the opening 10 from the front surface thereof and is fixed by screws to a stop plate **11*b* arranged internally of the space 2 and detachably mounted to the edge of the opening 10 together with the stop plate 11*b***.

The cover 11 has a central portion opened, and a case **11*d* for receiving the sensor 7 is detachably mounted from the front surface side thereof in the opening 11*c* and fixed by a magnet 11*e* to the cover 11**.

Accordingly, when the cover 11 or case 11d is removed as indicated by the imaginary line of FIG. 2, the front surface of the space 2 is opened, and check and maintenance of the electromagnetic valve 3, the stop cock 8 and connections of piping can be easily carried out from the opening 10 or 11*c*, and the maintenance of the sensor 7 within the case 11*d* can be carried out at the same time.

The sensor 7 received into the case 11*d* is of a so-called infrared sensor device, which uses a battery 9 common to the electromagnetic valve 3, the sensor being secured to the case 11d by means of a fixing bolt 7*b* on the back side, and a sensing portion 7*a* on the front side is exposed from the front surface of the cover 11.

When the sensor 7 senses a user who stands in front of the urinal A to open the electromagnetic valve 3, flushing water from the water pipe 12 passes through the communication pipe 6 to flow into the flushing water passage 5. Water then flows along the peripheral wall of the bowl portion 1 from a number of outflow holes 5*a* bored in the passage 5 to clean the bowl portion 1.

The urinal $A_1$ can be installed on the wall surface B of the urinal body a, and at the same time, the electromagnetic valve 3, the stop cock 8 and the communication pipe 6 can be completely received into the receiving space 2. Therefore, the external appearance when installed can be neatly set.

Figure 4:
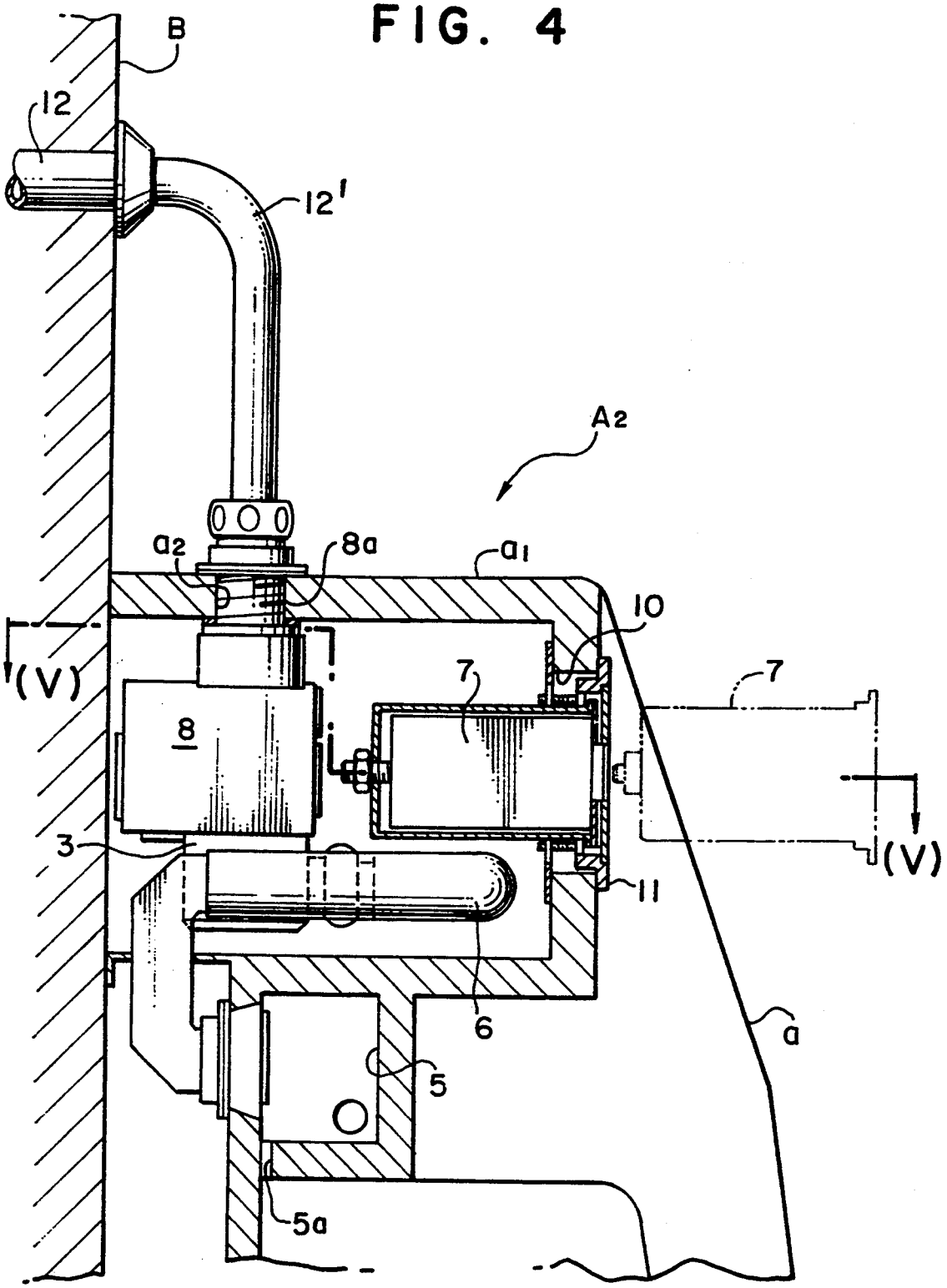
FIGS. 4 and 5 show a further embodiment of the urinal according to the present invention, FIG. 4 being a longitudinal sectional side view showing a valve portion, FIG. 5 being a sectional view taken on line V—V of FIG. 4.
Figure 5:
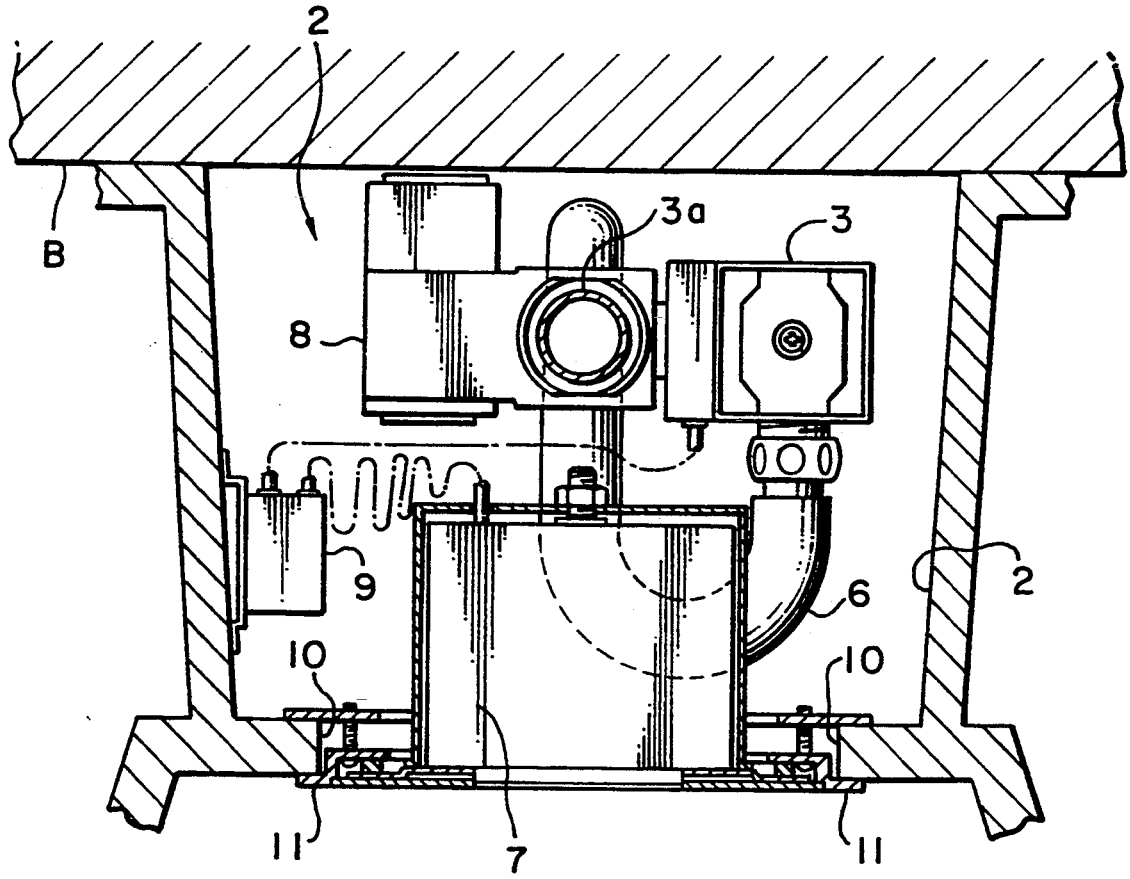

In the urinal $A_1$, the stop cock 8 and the electromagnetic valve 3 received into the space 2 are supported by the water pipe arranged in the wall surface B. However, the stop cock 8 and the electromagnetic valve 3 may be mounted and supported on any member. For example, as in a urinal $A_2$ shown in FIGS. 4 and 5, an inlet 8*a* of a stop cock 8 is fastened by nut to a through-hole $a_2$ made in an upper wall $a_1$ of a urinal body a whereby it is secured to the body a, and a water pipe 12' may be connected to the inlet 8*a* extending through the upper wall $a_1$.

Figure 6:
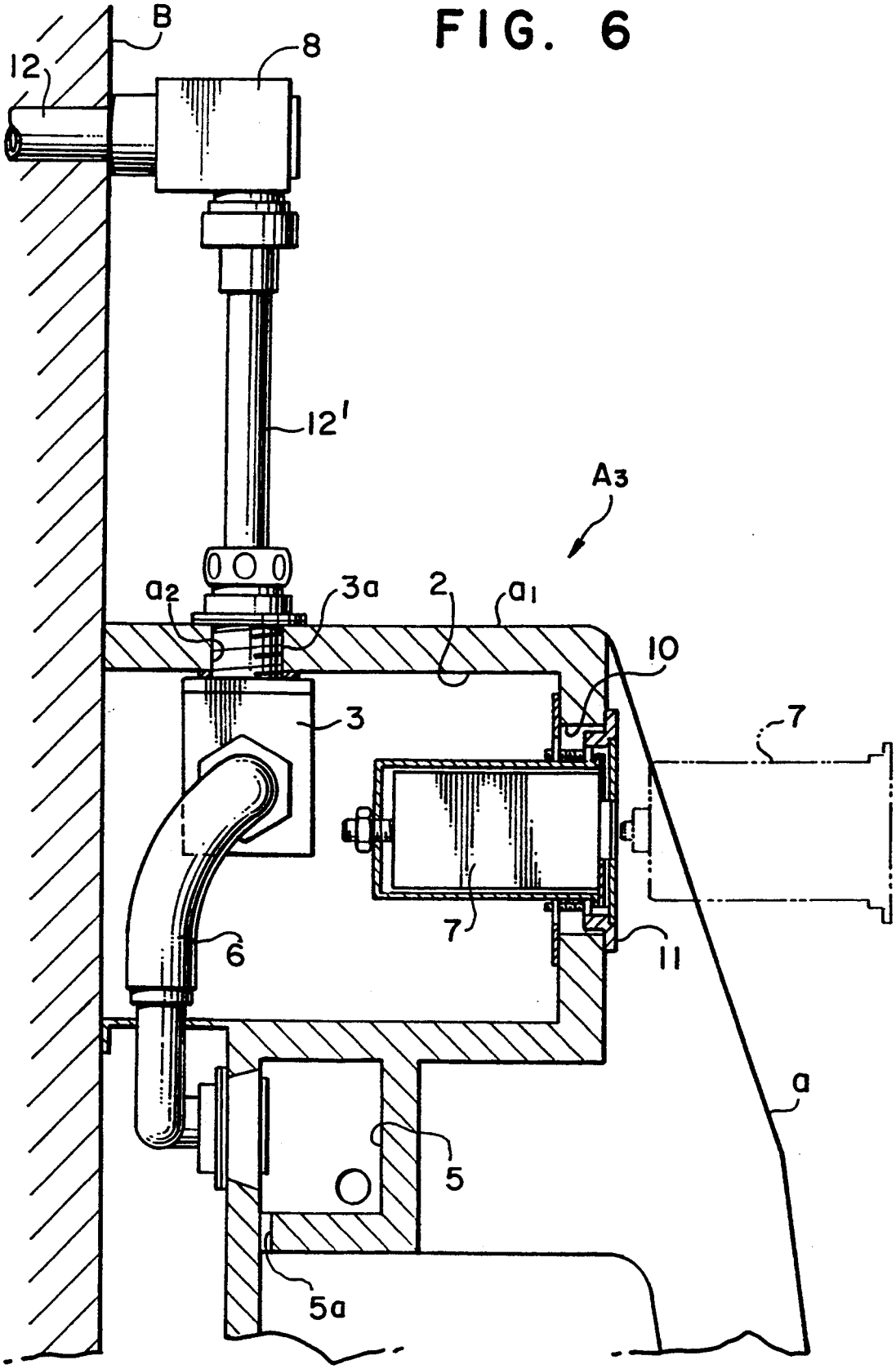
FIG. 6 is a longitudinal sectional side view showing a valve portion of a urinal according to a third embodiment of the present invention.

Alternatively, as in a urinal $A_3$ shown in FIG. 6, an inlet 3*a* of the electromagnetic valve 3 is fastened by nut to a through-hole $a_2$ of an upper wall a of the urinal body a, and a water pipe 12' is connected to the inlet 3*a* of the electromagnetic valve 3 extending through the upper wall $a_2$ and a stop cock 8 may be mounted halfway of the water pipe 12'.

In an arrangement as in the above-described urinals $A_2$ and $A_3$ wherein the electromagnetic valve 3 or the electromagnetic valve 3 and the stop cock 8 are fixedly mounted on the urinal body a in the state wherein they are received into the space 2, the electromagnetic valve 3 and the stop cock can be mounted during the manufacture. Therefore, it is possible to save time required for site execution when the urinals $A_2$ and $A_3$ are installed.

Figure 7:
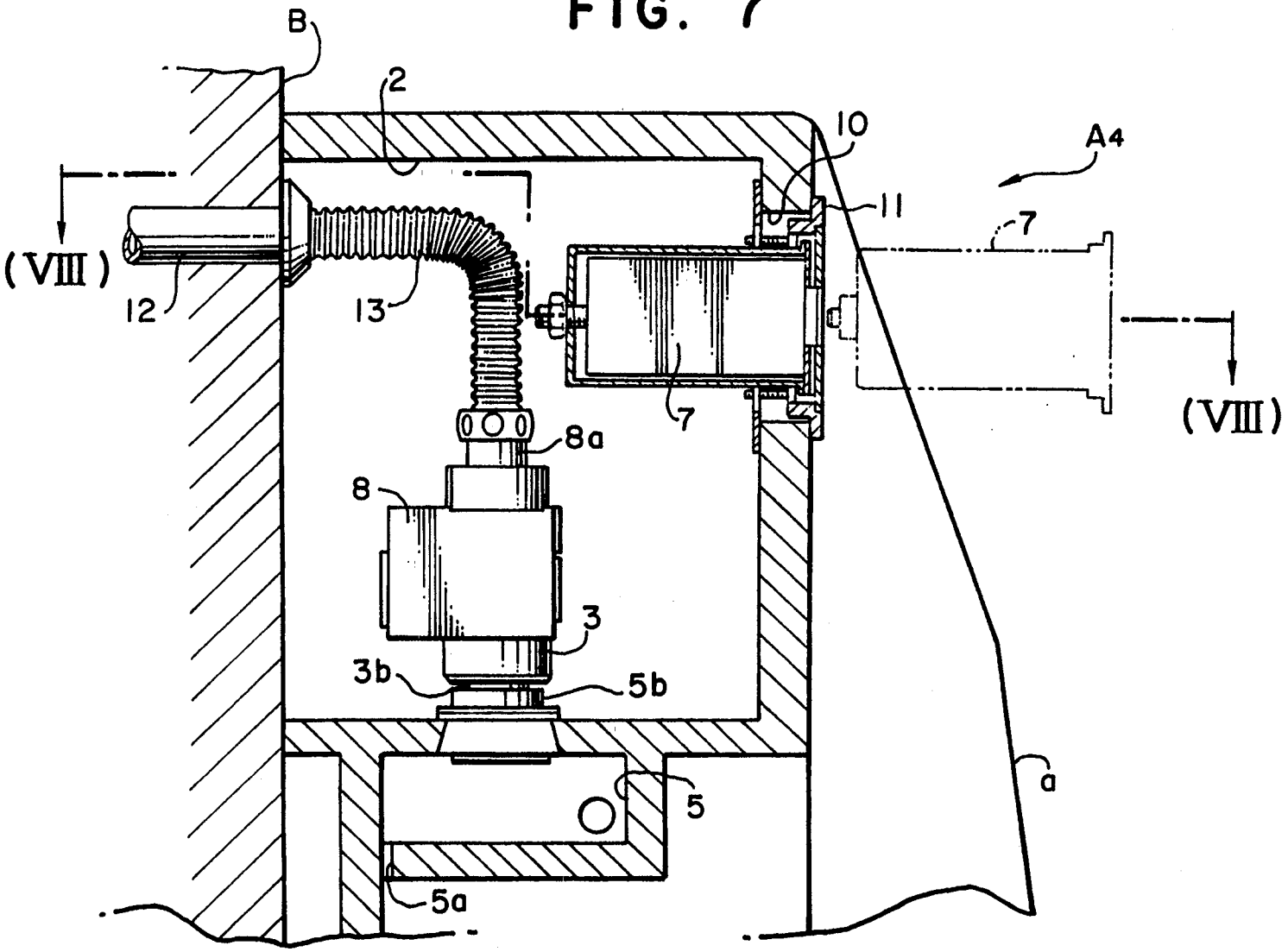
FIGS. 7 and 8 show a fourth embodiment of a urinal according to the present invention, FIG. 7 being a longitudinal sectional side view showing a valve portion, and FIG. 8 being a sectional view taken on line VIII—VIII of FIG. 7.
Figure 8:
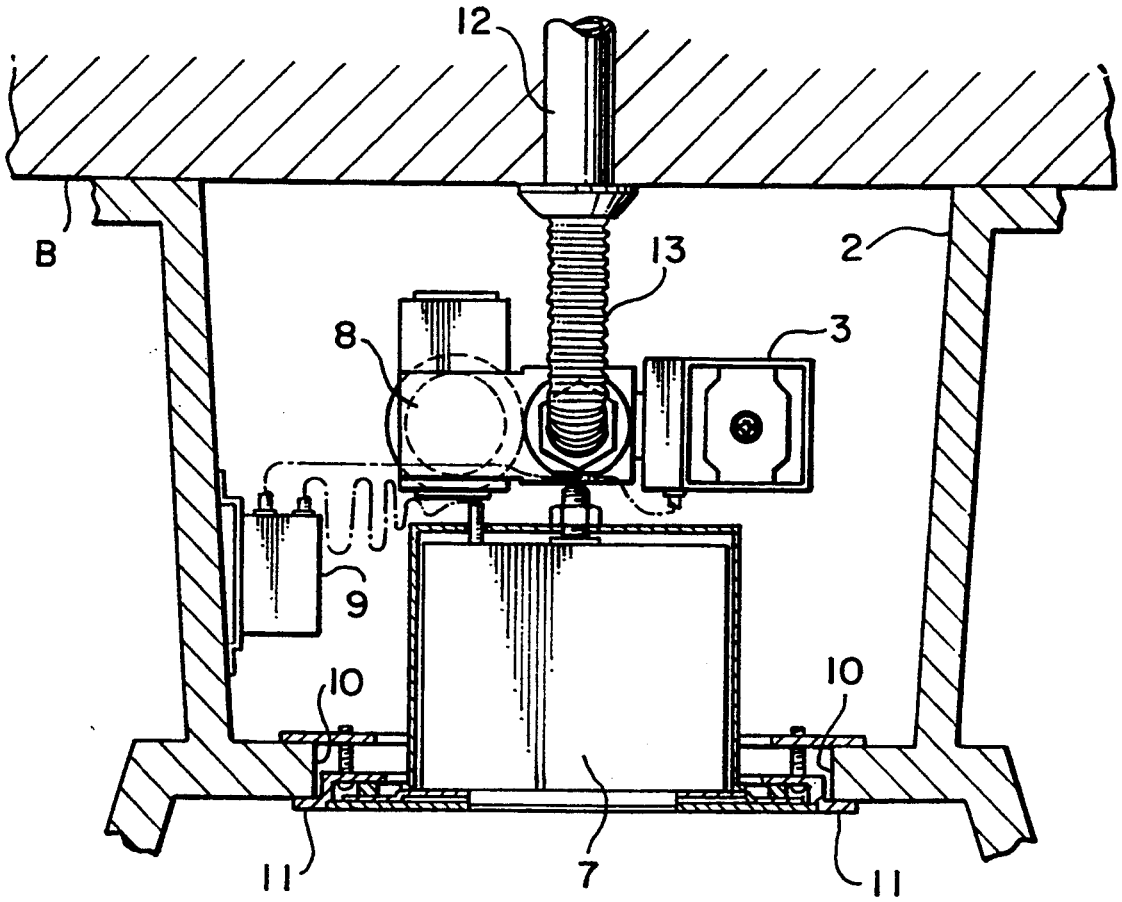

In a urinal $A_4$ shown in FIGS. 7 and 8, a stop cock 8 and an electromagnetic valve 3 which are connected in a communicating manner are received into a space 2, an outlet 3*b* of the electromagnetic valve 3 is directly connected to a base 5*b* provided on the upper wall of a flushing water passage 5, and an inlet 8*a* of the stop cock 8 and a water pipe 12 are connected by a flexible pipe 13.

According to the above-described urinal $A_4$, a communication pipe between the electromagnetic valve 3 and the flushing water passage 5 is not required, and the flexible pipe 13 is used to provide a communication between the water pipe 12 and the stop cock 8. Therefore, work for communication between the water pipe 12 and the stop cock 8 during installation can be easily accomplished.

A valve for supplying flushing water to a bowl portion is not limited to an electromagnetic valve but a flush valve may be used.

What is claimed is:

1. A urinal comprising:

a urinal body-having an upper portion, a lower portion, a back portion adapted to be mounted against a vertical wall and a front portion defining a urinal inlet opening facing away from said wall, said body including a housing defining a housing space having an access opening for accessing said space, said housing provided on the upper portion of said urinal body, said housing and said urinal body being formed as a one piece construction of the same material, said access opening opens in a direction towards the front portion of said urinal body;

a valve, disposed in said housing space, for supplying flushing water into a bowl portion of said urinal body said valve being adapted to be connected to a water supply pipe projecting from said wall, said housing comprising means for enabling said valve to be installed in said housing space by said valve having been inserted from a rear side of said housing space;

a control device having a sensor for sensing the presence of a user and for actuating said valve, said control device disposed in a front portion of said housing space such that said sensor is positioned adjacent said access opening; said valve positioned rearwardly of said control device; and a cover mounted over said access opening for opening and closing access to said opening.

2. The urinal according to claim 1, wherein said valve having been installed in said housing space from a rear side of said housing space, comprises an outlet which is positioned so as to communicate with a flow passage for providing flushing water into said bowl portion of said urinal body.

3. The urinal according to claim 1, wherein said valve is connected to a ceiling of said housing space, an upstream water supply pipe connected to said valve extending outwardly from said ceiling of said housing space, and a downstream water supply pipe is connected to the outlet of said valve to communicate with a flow passage for providing flushing water into said bowl portion of said urinal body.

4. The urinal according to claim 1, wherein said valve is connected to a ceiling of said housing space, an upstream water supply pipe connected to said valve and extending outwardly from said ceiling of said housing space through a stopcock, and a downstream water supply pipe is connected to the outlet of said valve to communicate with a flow passage for providing flushing water into said bowl portion of said urinal body.

5. The urinal according to claim 1, wherein said valve is fixed to a bottom of said housing space, an upstream water pipe formed by a flexible pipe is bendably arranged within said housing space to connect to a source supply line of flushing water provided in a wall to which said urinal is to be installed, and the downstream outlet of said valve communicating with a flow passage for providing flushing water into said bowl portion of said urinal body.

6. The urinal according to claim 1, wherein said sensor is remotely actuatable.

7. The urinal according to claim 1, wherein said cover has a central portion which is open.

8. The urinal according to claim 7, further comprising means for receiving said sensor, said means for receiving said sensor being detachably mounted in said central portion of said cover which is open.

9. The urinal according to claim 1, wherein said means for enabling said valve to be installed in said housing space by said valve having been inserted from a rear side of said housing space comprises an opening in said back portion.

10. The urinal according to claim 1, wherein said housing and said cover cover said valve, so that said valve is completely enclosed within said housing when said urinal is mounted on a vertical wall and said cover is mounted over said access opening.

11. The urinal according to claim 1 wherein said valve is adapted to be connected, within said housing, to a water supply pipe projecting from said wall.

* * * * *